US006041759A

United States Patent [19]

Burborough

[11] Patent Number: 6,041,759

[45] Date of Patent: Mar. 28, 2000

[54] ADVANCE ARRANGEMENT

[75] Inventor: William Robert Burborough, Gillingham, United Kingdom

[73] Assignee: Lucas Industries, London, United Kingdom

[21] Appl. No.: 09/196,082

[22] Filed: Nov. 19, 1998

[30] Foreign Application Priority Data

Dec. 2, 1997 [GB] United Kingdom ..... 9725415

[51] Int. Cl.[7] ..... F02M 37/04

[52] U.S. Cl. ..... 123/501; 123/502; 123/179.17

[58] Field of Search ..... 123/500–502, 123/179.16, 179.17

[56] References Cited

U.S. PATENT DOCUMENTS 4,037,573 7/1977 Swift .
4,037,574 7/1977 Swift .
5,188,083 2/1993 Reisser et al. ..... 123/502
5,263,457 11/1993 Konrath ..... 123/502
5,370,096 12/1994 Cooke et al. ..... 123/502

*Primary Examiner*—Thomas N. Moulis
*Attorney, Agent, or Firm*—Ohlandt, Greeley, Ruggiero & Perle

[57] ABSTRACT

An advance arrangement comprises an advance piston slidable within a bore, the advance piston cooperating, in use, with a cam arrangement of a fuel pump to adjust the timing of fuel delivery by the pump, a servo-piston slidable in a bore provided in the advance piston, a light load piston moveable relative to the advance piston against the action of a light load control spring, a servo control spring engaged between the light load piston and the servo-piston, a light load control valve operable to control the application of fuel to the light load piston to adjust timing under light load conditions, and an independent temperature control valve operable to control the application of fuel to the light load piston depending upon the engine temperature to permit adjustment of the timing of fuel delivery to compensate for cold conditions.

4 Claims, 4 Drawing Sheets

ADVANCE ARRANGEMENT

This invention relates to an advance arrangement for use in controlling the timing of fuel delivery by a high pressure fuel pump intended for use in a compression ignition internal combustion engine. In particular, the invention relates to a servo-type advance arrangement including light load and cold advance features.

U.S. Pat. No. 4,037,573 and U.S. Pat. No. 4,037,574 both describe rotary fuel pumps in which the angular position of a cam ring is adjusted by a servo-advance arrangement to control the timing of fuel delivery by the pump. The servo-piston of the arrangement acts against a spring which is seated upon a load sensing piston. Depending upon the engine load, the pressure of fuel acting on the load sensing piston varies, and the position of the load sensing piston changes. The movement of the load sensing piston results in movement of the servo-piston which, in turn, causes movement of an advance piston. The movement of the advance piston causes movement of the cam ring adjusting the timing of fuel delivery by the pump.

Although these known arrangements permit timing adjustment depending upon load, no adjustment is made to compensate for cold engine conditions.

According to the present invention there is provided an advance arrangement comprising an advance piston slidable within a bore, the advance piston cooperating, in use, with a cam arrangement of a fuel pump to adjust the timing of fuel delivery by the pump, a servo-piston slidable in a bore provided in the advance piston, a light load piston moveable relative to the advance piston against the action of a light load control spring, a servo-control spring engaged between the light load piston and the servo-piston, a light load control valve operable to control the application of fuel to the light load piston to adjust timing under light load conditions, and an independent temperature control valve operable to control the application of fuel to the light load piston depending upon the engine temperature to permit adjustment of the timing of fuel delivery to compensate for cold conditions.

It will be appreciated that such an arrangement permits adjustment of fuel delivery timing both in response to load and engine temperature.

Preferably, the advance arrangement is configured so that, beyond a predetermined position of the advance piston, fuel from the temperature control valve is no longer applied to the light load piston.

The invention will further be described, by way of example, with reference to the accompanying drawings, in which.

Figure 1:
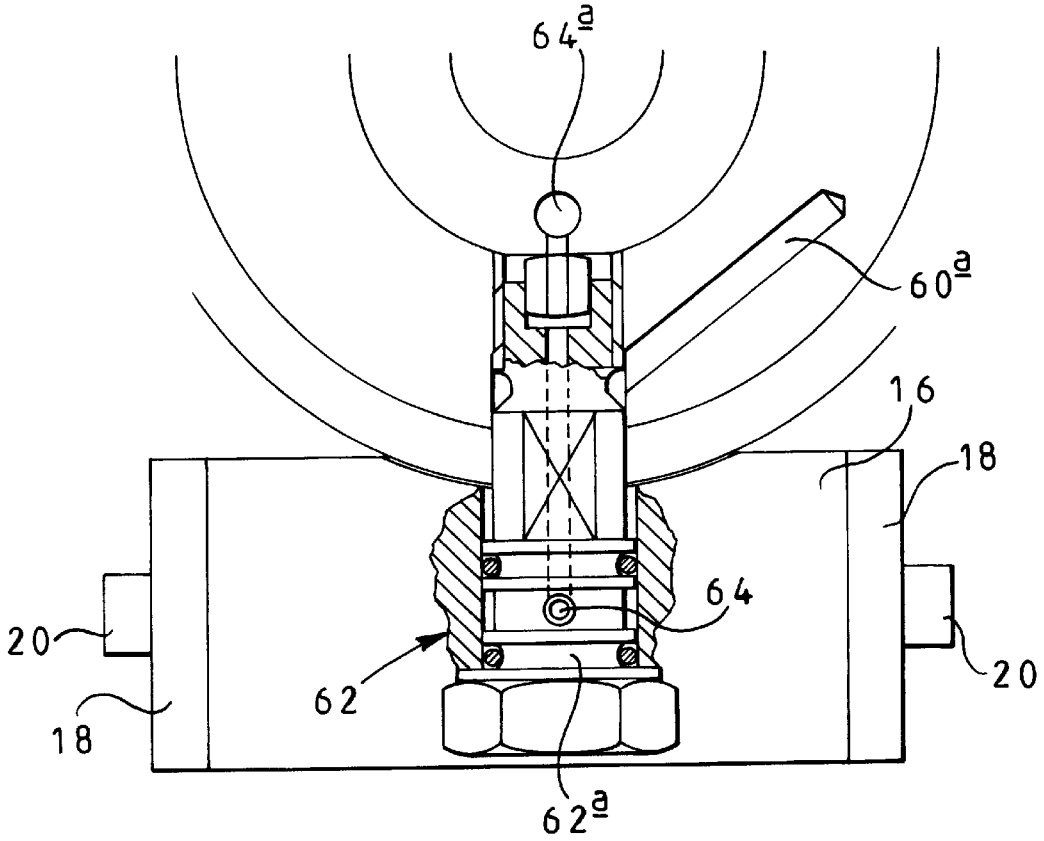
FIG. 1 is a view, part in section, illustrating part of a fuel pump incorporating an advance arrangement in accordance with an embodiment of the invention.
Figure 2:
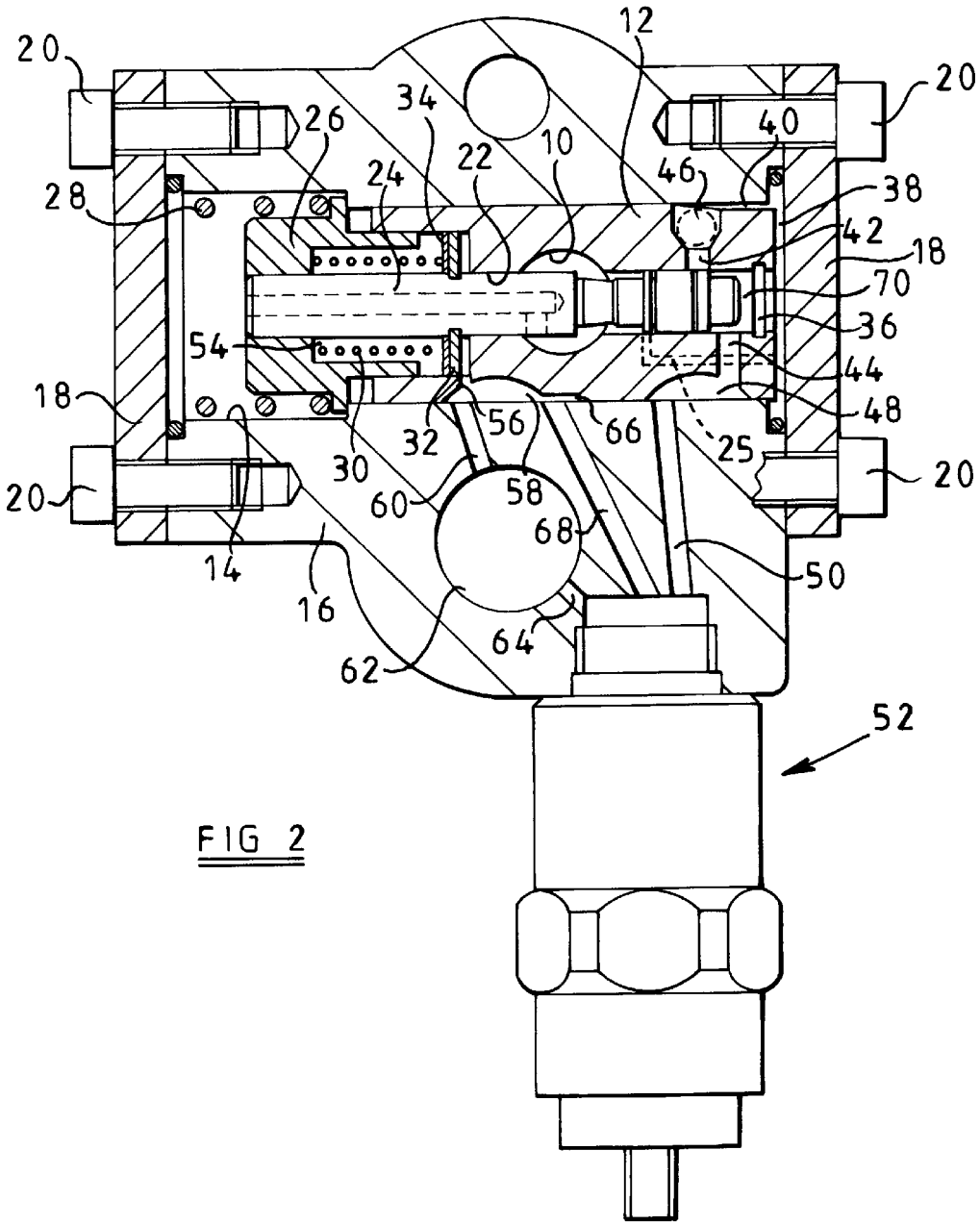
FIG. 2 is another view illustrating the advance arrangement.

FIGS. 1 and 2 illustrate part of a rotary fuel pump which includes a cam ring which is angularly adjustable with respect to a pump housing, the cam ring including a plurality of cam lobes. The cam ring encircles part of a distributor member which includes pumping plungers reciprocable within respective bores of the distributor member, the plungers having associated therewith respective shoe and roller arrangements the rollers of which are engageable with the cam surface of the cam ring. In use, fuel is supplied to the bores of the distributor member by a transfer pump, pushing the plungers thereof radially outwards. The output pressure of the transfer pump is controlled so as to be related to the speed of operation of the engine with which the pump is being used. Rotation of the distributor member relative to the cam ring causes the rollers to move relative to the cam ring, engagement of the rollers with the cam lobes causing the plungers to be forced inwards, pressurizing the fuel within the bores, and causing fuel to be delivered by the fuel pump at high pressure. Clearly, by altering the angular position of the cam ring, the timing at which fuel is delivered by the pump can be adjusted.

In order to permit adjustment of the angular position of the cam ring, the cam ring is provided with a peg which extends into an opening 10 provided in an advance piston 12 which is slidable within a bore 14 provided in a cam box housing 16. The ends of the bore 14 are closed by end plates 18 which are secured to the cam box housing 16 by means of bolts 20, appropriate O-rings being used to seal the end plates 18 to the housing 16.

The advance piston 12 includes an axially extending bore 22 within which a servo-piston member 24 is slidable. A light load piston 26 is also received within the bore 14, the light load piston 26 including a central opening through which the servo-piston 24 extends, the servo-piston 24 acting to guide movement of the light load piston 26, the servo-piston 24 being a substantially fluid tight, sliding fit within the opening of the light load piston 26 and within the bore 22 of the advance piston 12. A light load control spring 28 is engaged between the light load piston 26 and one of the plates 18 to bias the light load piston 26 into engagement with a step defined by part of the bore 14.

A servo control spring 30 is engaged between the light load piston and an annular member 32 which is carried by the servo-piston 24. As illustrated in FIG. 2, a shim 34 is located between the spring 30 and annular member 32. The shim 34 acts to control the maximum permitted movement of the servo-piston towards the light load piston 26, the movement being limited by the engagement of the shim 34 with an end surface of the light load piston 26.

The end of the bore 22 remote from the light load piston 26 is closed by means of a disk-shaped member 36 which is located within an annular groove formed in the advance piston 12, the location of the member 36 being achieved, for example, using an appropriate thermal expansion technique. Alternatively, the bore may be closed by means of a core plug, bolt or the like. Clearly, movement of the servo-piston 24 relative to the advance piston 12 is limited by engagement of an end of the servo-piston 24 with the member 36.

A first control chamber 38 is defined by an end face of the advance piston 12 remote from the light load piston 26, the associated part of the bore 14, and the associated end plate 18. The first control chamber 38 communicates via a channel 40 formed in the outer periphery of the advance piston 12 with a radially extending passage 42 within which a non-return valve 46 is located. The radially extending passage 42 communicates with the bore 22, and depending upon the position of the servo-piston 24, the radially extending passage 42 may communicate with a second radially extending passage 44 which opens into a recess 48 provided in the outer surface of the advance piston 12. The recess 48 is located so that for all permitted positions of the advance piston 12 relative to the housing 16, the recess 48 communicates with a passage 50 which communicates with a chamber defined between the housing 16 and an electromagnetically operated temperature control valve 52 mounted upon the housing 16, the chamber communicating constantly with a bore 64 which communicates with a bore 62.

The advance piston 12 and light load piston 26 together define a second control chamber 54 within which the spring 30 is located, the second control chamber 54 communicating with a radially extending passage 56 which opens into a recess 58 provided in the outer surface of the advance piston 12. The recess 58 is located so that for all permitted positions of the advance piston 12, the recess 58 communicates with a passage 60 which communicates with the bore 62.

The bore 62 contains a passage defining member 62*a* which ensures that the bore 64 communicates, constantly, with a passage 64*a* containing fuel at transfer pressure, and the passage communicates with a drilling 60*a* which communicates with a metering valve.

Extending from the recess 58, the outer surface of the advance piston 12 is provided with a short flat 66 which, depending upon the axial position of the advance piston 12, is arranged to communicate with a passage 68 which communicates with the temperature control valve 52.

Under normal operating conditions, where the engine is hot and the engine load is reasonably high, the temperature control valve 52 is switched so that fuel at transfer pressure is supplied through the passage 64 to the passage 50, but is not supplied to the passage 68. Further, the metering valve supplies fuel at low pressure to the passage 60. In these conditions, the fuel pressure within the second control chamber 54 is relatively low, thus the light load piston 26 is biased by means of the spring 28 into engagement with the shoulder of the bore 14 as illustrated. Fuel at transfer pressure is supplied through the passage 50, recess 48 and passage 44 to a chamber 70 defined by the bore 22 of the advance piston 12, the end of the servo-piston 24 and the member 36. In the position shown, the servo-piston 24 occupies a position in which communication between the chamber 70 and the radially extending passage 42 is not permitted. However, should the speed of rotation of the engine increase resulting in an increase in the transfer pressure, the fuel pressure within the chamber 70 may increase to a sufficient extent to cause movement of the servo-piston 24 against the action of the spring 30 to a position in which communication between the chamber 70 and radially extending passage 42 is permitted. In these circumstances fuel flows from the chamber 70 through the radially extending passage 42 and past the nonreturn valve 46 to the first control chamber 38. The flow of fuel to the chamber 38 increases the pressure therein, applying a force to the advance piston 12 causing the piston 12 to move towards the left in the orientation illustrated in FIG. 2. Movement of the advance piston 12 in this direction causes movement of the cam ring, due to the cooperation of the peg with the opening 10, to advance the timing of fuel delivery by the pump.

It will be appreciated, in use, that at the instant at which the rollers move into engagement with the cam lobes provided on the cam ring, a significant force is transmitted through the cam ring and peg to the advance piston 12, tending to move the advance piston 12 towards the right in the orientation illustrated. Clearly such movement would tend to increase the fuel pressure within the control chamber 38, and the nonreturn valve 46 is provided in order to avoid the increase in fuel pressure within the chamber 38 resulting in fuel flow in the reverse direction.

Once the movement of the advance piston 12 results in the passage 42 being closed by the servo-piston 24, the supply of fuel to the chamber 38 is terminated and movement of the advance piston in this direction ceases.

Clearly, in circumstances in which it is desirable to retard the timing of fuel delivery by the pump, the advance piston 12 must move towards the right in the orientation illustrated. In such circumstances, the transfer pressure falls, thus the servo-piston 24 moves towards the right. Movement of the servo-piston 24 relative to the advance piston 12 beyond a predetermined position results in a drain passage 25 being uncovered permitting fuel to escape from the control chamber 38 to the cam box of the high pressure fuel pump. The fuel pressure within the control chamber 38 thus falls, resulting in movement of the advance piston 12 to the right. Movement of the advance piston ceases upon the advance piston having moved to a position in which the drain passage 25 is closed by the servo-piston.

Figure 3:
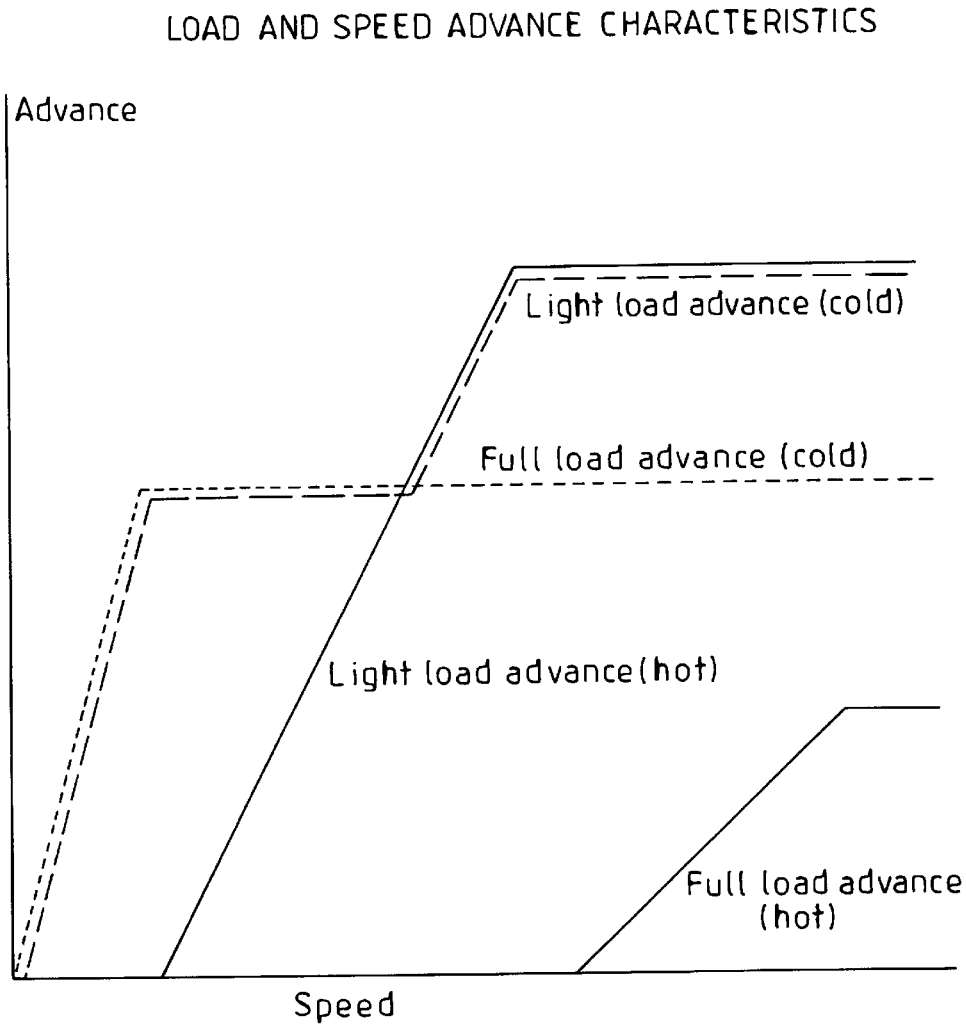
FIG. 3 is a graph illustrating the advance characteristics of the arrangement in various modes of operation.
Figure 4:
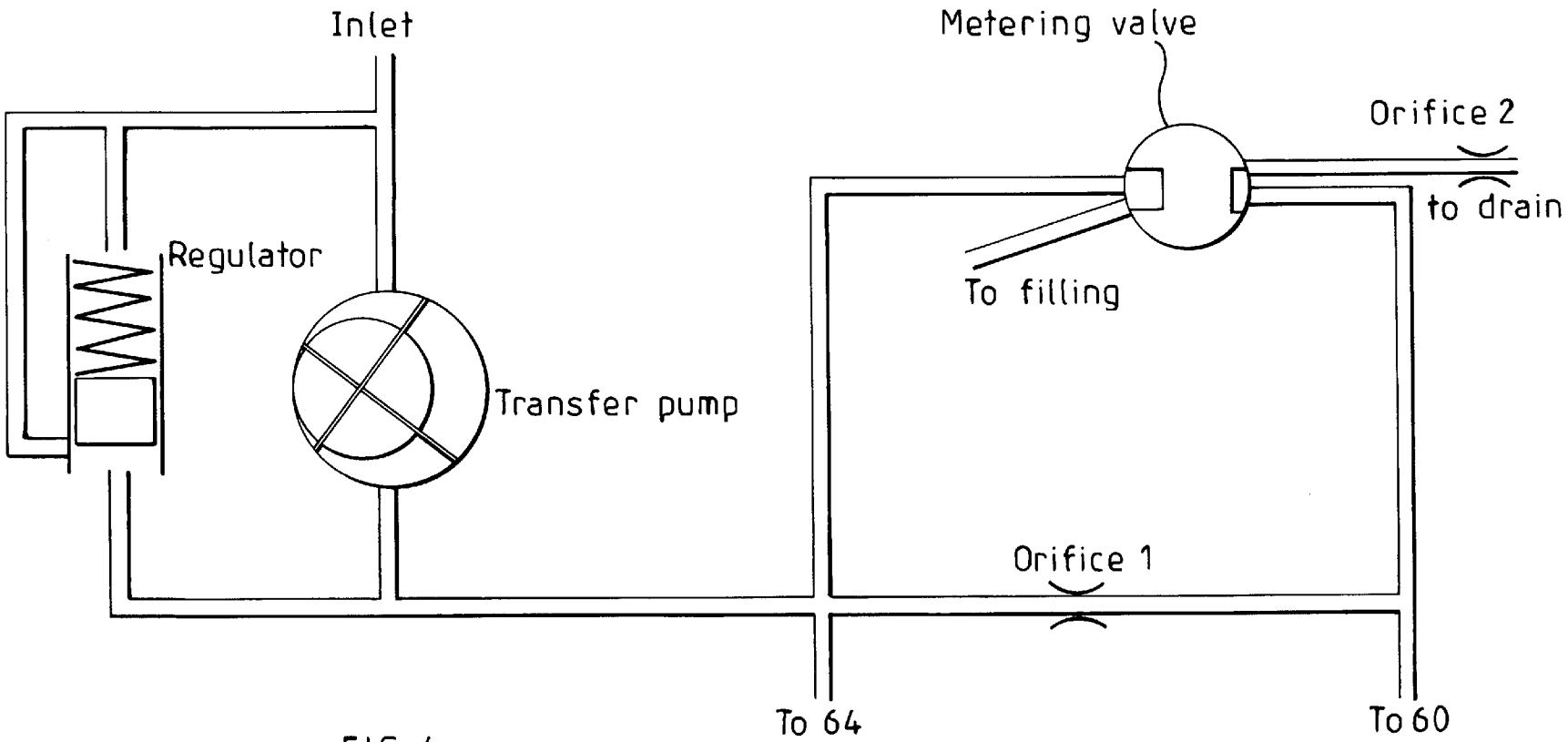
FIG. 4 is a hydraulic circuit diagram for the advance arrangement.

FIG. 3 illustrates the load and speed advance characteristics for the fuel pump under full load advance conditions where the engine is hot, and as illustrated in FIG. 3, the maximum permitted advance is relatively low. In practice, the maximum advance is limited by the engagement of the end of the advance piston 12 remote from the control chamber 38 with the light load piston 26.

Turning to the condition where the engine is operating at a relatively light load, the engine being hot, in these conditions the metering valve allows the pressure applied to the passage 60 to rise. The fuel pressure applied to the second control chamber 54 hence rises. The application of fuel at increased pressure to this chamber results in movement of the light load piston 26 against the action of the spring 28. Clearly such movement of the light load piston 26 reduces the compression of the spring 30, and the application of fuel to the chamber 70 as described hereinbefore causes movement of the servo-piston 24 to the left in the orientation illustrated. As described hereinbefore, the movement of the servo-piston 24 permits fuel to flow to the first control chamber 38 resulting in movement of the advance piston 12 to the left, advancing the timing of fuel delivery by the pump.

As illustrated in FIG. 3, the effect of moving the light load piston 26 has an effect upon the relationship between engine speed and the rate of adjustment of timing of fuel delivery by the pump, and also as the light load piston 26 is moved, the maximum permitted level of advance is also increased.

For both of the operating conditions described hereinbefore, the temperature control valve 52 may be switched in order to adjust timing to compensate for the engine being cold. The effect of switching the temperature control valve 52 is that fuel at transfer pressure is supplied to the passage 68. In the position illustrated in FIG. 2, fuel from the passage 68 flows through the flat 66 to the recess 58 and from there to the second control chamber 54. The application of fuel to the second control chamber 54 results in movement of the light load piston 26, and described hereinbefore, this results in adjustment of the position of the advance piston 12. Assuming, firstly, that the engine is running at high load, thus fuel is not being supplied through the passage 60 to the second control chamber 58, then after a predetermined movement of the advance piston 12, the passage 68 no longer registers with the flat 66, thus further fuel is no longer permitted to flow to the second control chamber 54. This break in communication results in movement of the light load piston 26 to the left in the orientation illustrated being limited. However, should the engine be operating at light load conditions, fuel is able to flow through the passage 60 to the second control chamber 54, thus movement of the light load piston 26 to the left continues. FIG. 3 shows the load and speed advance characteristics for both of these operating conditions.

The provision of such an advance arrangement has the advantage that the high load conditions can operate over an increased pressure range, thus permitting an increase in the stiffness of the spring 30 resulting in greater stability and more consistent operation. The light load advance condition can also operate over a larger pressure range without interfering with the operation of the advance arrangement under full load conditions. As separate springs are used to control the operation under full load and light load, the characteristics of these springs can be optimised for the pump with which the advance arrangement is to be used. Also, as, at full load, movement of the servo-piston 24 is limited by engagement with the light load piston 26, the maximum advance position of the advance piston 12 is well defined, and operation of the engine under these conditions is more stable.

Clearly, by altering the length of the flat 66, the maximum advance under cold conditions at full load can be controlled independently of the other operating characteristics of the arrangement. As illustrated in FIG. 3, under low load conditions, the length of the flat 66 is of less importance as the position of the low load piston 26 is determined by the pressure of fuel supplied through the passage 60 to the second control chamber 54 under these conditions.

Conveniently, the temperature control valve 52 takes the form of a conventional stop solenoid which is supplied with electrical current only when the engine is at low temperature. Clearly, should the temperature control valve 52 fail, then it is likely to fail in the high temperature condition. This has the advantage that breaking the supply to the condition valve 52 does not result in improved performance of the engine at the expense of emissions, thus reducing the risk of tampering.

Although the description hereinbefore is of a fuel pump of the type in which pumping plungers move in a radial direction in order to supply fuel at high pressure to an engine, it will be appreciated that the advance arrangement may be applicable to other types of high pressure fuel pump.

What is claimed is:

1. An advance arrangement comprising an advance piston slidable within a bore, the advance piston cooperating, in use, with a cam arrangement of a fuel pump to adjust the timing of fuel delivery by the pump, a servo-piston slidable in a bore provided in the advance piston, a light load piston moveable relative to the advance piston against the action of a light load control spring, a servo control spring engaged between the light load piston and the servo-piston, a light load control valve operable to control the application of fuel to the light load piston to adjust timing under light load conditions, and an independent temperature control valve operable to control the application of fuel to the light load piston depending upon the engine temperature to permit adjustment of the timing of fuel delivery to compensate for cold conditions.

2. An advance arrangement as claimed in claim 1, wherein beyond a predetermined position of the advance piston, fuel from the temperature control valve is no longer applied to the light load piston.

3. An advance arrangement as claimed in claim 2, wherein the advance piston is provided with a port registrable with a passage associated with the temperature control valve to determine whether or not fuel is permitted to flow from the temperature control valve to the light load piston.

4. An advance arrangement as claimed in claim 1, wherein the temperature control valve comprises a solenoid controlled valve.

* * * * *